United States Patent [19]

Black et al.

[11] Patent Number: 4,558,305

[45] Date of Patent: Dec. 10, 1985

[54] MULTIPLE TONE SIGNALING DEVICE

[75] Inventors: Donald E. Black, Indianapolis; Louis P. Sweany, Carmel; James D. Pirtle, Lawrence, all of Ind.

[73] Assignee: Emhart Industries, Inc., Indianapolis, Ind.

[21] Appl. No.: 450,965

[22] Filed: Dec. 20, 1982

[51] Int. Cl.[4] ..... G08B 3/00

[52] U.S. Cl. ..... 340/384 E; 340/384 R; 331/47

[58] Field of Search ..... 340/384 E, 384 R; 331/47, 49, 55, 56

[56] References Cited

U.S. PATENT DOCUMENTS

| | | | |
|---|---|---|---|
| 3,416,065 | 12/1968 | Redfern | 331/47 |
| 3,774,148 | 11/1973 | McIntosh | 340/384 E |
| 3,868,684 | 2/1975 | Nunn | 340/384 E |
| 3,875,526 | 4/1975 | Beeman et al. | 331/47 |
| 4,088,995 | 5/1978 | Paladino | 340/384 R |
| 4,193,060 | 3/1980 | Slavin et al. | 340/384 E |
| 4,257,036 | 3/1981 | Slavin et al. | 340/384 E |
| 4,374,377 | 2/1983 | Saito et al. | 340/384 E |

OTHER PUBLICATIONS

"Hee-Haw Siren for Toy Cars", Gerald Cohn, Electronics, Jun. 1980, pp. 77–79, vol. #42.

"Multi-Option Siren", Ray Marston, Electronics Today Inc., vol. 10, Jan. 1981, pp. 22–24.

"Linear IC Siren Warbles, Wails, Sweeps", Tom Hopkins, Electronic Design, vol. 28, No. 17, pp. 190–192, Aug. 16, 1980.

*Primary Examiner*—John W. Caldwell, Sr.

*Assistant Examiner*—Tyrone Queen

*Attorney, Agent, or Firm*—Robert F. Meyer

[57] ABSTRACT

A multiple tone signaling device provides a piezoelectric transducer, first, second and third oscillator circuits, a first input terminal for enabling either or both of the first and second oscillator circuits, circuitry coupling the third oscillator circuit to the first and second oscillator circuits for disabling either the first or second oscillator circuits in response thereto, and a second input terminal coupled to the third oscillator circuit for allowing control of the output of said third oscillator circuit.

9 Claims, 2 Drawing Figures

MULTIPLE TONE SIGNALING DEVICE

BACKGROUND OF THE INVENTION

1. Field of the Invention

The present invention generally relates to audio tone signaling devices and, in particular, to such signaling devices which employ multiple audio tones.

2. Statement of the Prior Art

Audio tone signaling devices are well known and widely used. Their application in electrical and electronic devices are too numerous to mention. Some of the purposes for which they are used to provide a signal are the existence of a condition, the end of an operating cycle, the end of a period of time, or as a reminder of something. In some instances, a signaling device will be used to signal just a single function and in other cases, it will be used to signal multiple functions. The signaling of multiple functions in some instances may be handled by the number and time duration of the pulses produced by a signaling device. However, with the growing complexity and applications of electronic systems, the number and type of functions which must be signalled are often too complex for the use of just a single frequency tone For example, safety reasons dictate that an emergency signal not have a sound which is similar to the simple condition indicator or time period indicator.

SUMMARY OF THE INVENTION

Accordingly, a signaling device is provided which uses a pair of audio tone oscillators in an arrangement which enables different tone signals of variable length and repeatability, pulsating versions of both audio tone signals and a warble signal consisting of both audio tone frequencies. The signaling device comprises an audio output device, a first oscillator circuit means for oscillating at a first frequency, a second oscillator circuit means for oscillating at a second frequency, a third oscillator circuit means for oscillating at a third frequency, means coupling the audio output device to the first and second oscillator circuit means, first input terminal means coupled to the first and second oscillator circuit means for allowing enabling of either or both of the first and second oscillator circuit means, circuit means coupling the third oscillator circuit means to the first and second oscillator circuit means for disabling either the first or second oscillator circuit means in response thereto and second input terminal means coupled to the third oscillator circuit means for enabling control of said third oscillator circuit means.

BRIEF DESCRIPTION OF THE DRAWINGS

The present invention is illustratively shown and described in relation to the accompanying drawings in which.

DETAILED DESCRIPTION OF THE DRAWINGS

Figure 1:
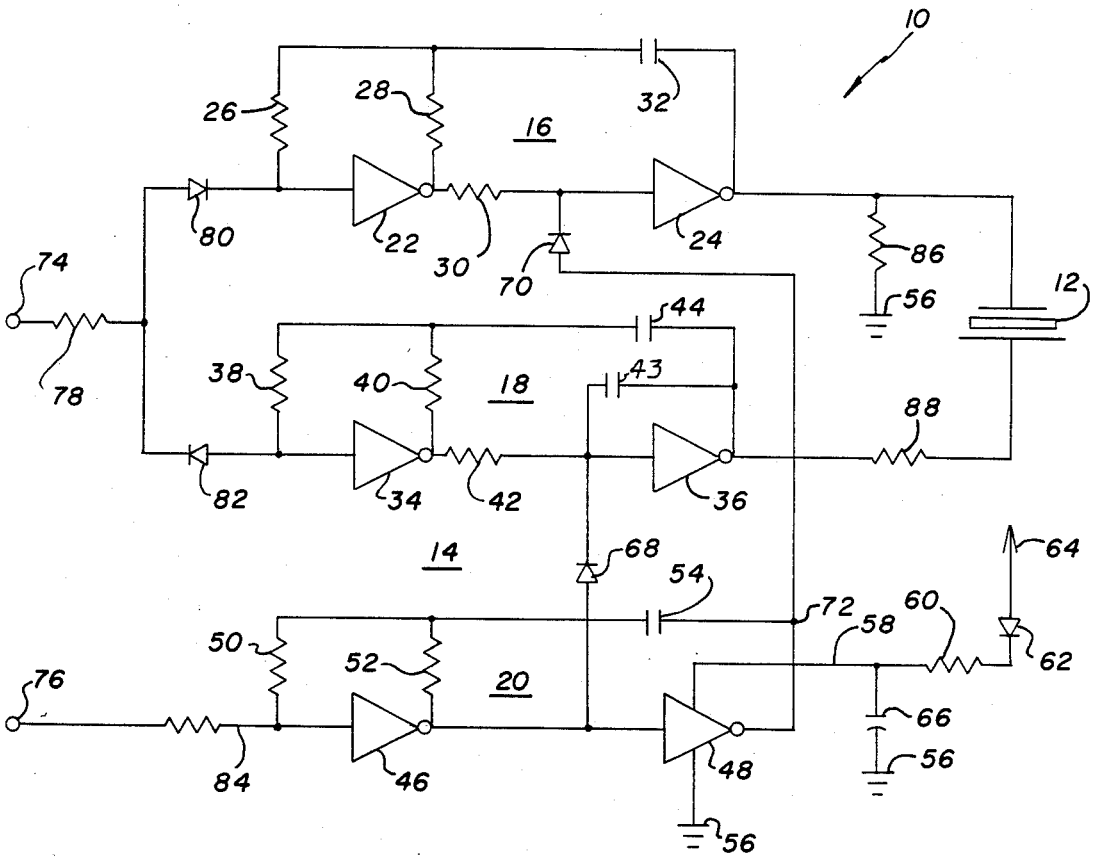
FIG. 1 is a schematic diagram of one embodiment of the present invention.

In reference to FIG. 1, a circuit is shown for producing a multiplicity of audio tone signals by means of a transducer 12 and drive circuitry 14. The drive circuitry 14 includes a first oscillator circuit 16 for generating a first audio frequency, a second oscillator circuit 18 for generating a second audio frequency and a third oscillator circuit 20 for generating a third frequency. The third frequency is presently a sub-audio frequency used for the switching of the first and second audio frequency signals. The audio frequency oscillator circuit 16 includes a pair of inverters 22 and 24, three resistors 26, 28 and 30 and a capacitor 32. The resistor 28 and the capacitor 32 determine the oscillation frequency of the circuit 16. The circuit arrangement is that of a commonly known square wave oscillator.

The oscillator circuit 18 includes a pair of inverters 34 and 36, three resistors 38, 40 and 42 and two capacitors 43 and 44. The combination of resistor 40 and capacitor 44 determine the oscillation frequency of the circuit 18. The circuit 18 is a standard square wave oscillator circuit similar to circuit 16 and, in the present embodiment, has a higher frequency of oscillation than circuit 16. The oscillation frequency of both oscillator circuits 16 and 18 is within the audio range.

The oscillator circuit 20 includes a pair of inverters 46 and 48, resistors 50 and 52 and a capacitor 54. The combination of resistor 52 and capacitor 54 determine the oscillation frequency of the circuit 20 which, in the present case, is a sub-audio frequency.

The inverters 22, 24, 34, 36, 46 and 48 may be part of an integrated circuit package including at least six such inverters. Power would normally be supplied to the entire package via connections shown to the inverter 48. These connections include a ground 56 and a positive voltage input line 58 connected through a current limiting resistor 60 and a reverse voltage protection diode 62 to a voltage input terminal 64. A capacitor 66 connects the voltage input wire 58 to the system ground 56.

The circuit further includes means for disabling either one of the oscillators 16 or 18 by means of the diodes 68 and 70. The oscillator circuit 20 includes an output available at the circuit point 72 corresponding to the output of inverter 48 and which is also available in its inverted form at the input of inverter 48. The diode 70 is connected by its anode to circuit point 72 and by its cathode to the input of inverter 24 The diode 68 is connected by its anode to the input of inverter 48 and by its cathode to the input of inverter 36. Thusly connected, when the output of oscillator circuit 20 is a logical high the input of inverter 24 will be held to a logical high and therefore its output will remain at a logical low preventing oscillator 16 from oscillating. When the output of oscillator circuit 20 is a logical low, a logical high is transmitted via diode 68 to the input of inverter 36 to hold the output thereof at a logical low.

The circuit 10 further includes a pair of control input terminals 74 and 76. The terminal 74 is coupled to oscillator circuits 16 and 18 by means of a resistor 78. The other end of resistor 78 is coupled through a diode 80 to the input of inverter 22 and through a diode 82 to the input of inverter 34. The input control terminal 76 is connected via a resistor 84 to the input terminal of inverter 46.

An audio output device in the form of a piezoelectric transducer 12 is coupled between the outputs of inverters 24 and 36. A resistor 86 is connected between the output of inverter 24 and the system ground 56 and a resistor 88 is connected in series between the output of inverter 36 and the piezoelectric transducer 12.

The circuit operates in the following manner. The oscillator circuits 16 and 18 oscillate at audio frequencies which are different. In the present embodiment, the frequency of oscillator 16 is lower than the frequency of oscillator 18. The difference between the oscillation frequencies is sufficient to enable clear aural differentiation therebetween. The oscillator circuit 20 oscillates at a sub-audio frequency which may be termed a pulsation. When neither of the input terminals 74 or 76 is tied to a logical ground or a logical high, the oscillators 16, 18 and 20 are allowed to freely oscillate. This condition of the input terminals 74 and 76 is usually established by leaving an open circuit to ground or by allowing only a high impedance to ground.

When the oscillators 16, 18 and 20 are all oscillating freely, the oscillator 20 alternately disables the oscillators 16 and 18 in accordance with the oscillation frequency of oscillator 20. In other words, when the output of oscillator 20 at circuit point 72 is a logical high, the low frequency oscillator 16 is held to a logical low at its output and is thereby disabled. Under this condition, the logical low appearing at the input of inverter 48 is blocked from the input of inverter 36 via the diode 68 and the high frequency oscillator 18 is allowed to oscillate freely. When the output of the pulsating oscillator 20 at terminal 72 is a logical low, a logical high is transmitted from the input of inverter 48, through diode 68 to the input of inverter 36. This causes the output of inverter 36 to hold at a logical low thus disabling the oscillator 18. The logical low at circuit point 72 is blocked from the oscillator 16 by the diode 70 thus allowing the oscillator 16 to operate freely. Thus, as the oscillator 20 oscillates at its pulsation frequency, the oscillators 16 and 18 are alternately caused to operate producing a warble tone from the piezoelectric transducer 12.

When a logical high is applied to the input terminal 74, the diode 80 couples that logical high to the input of inverter 22 causing its output to go to a logical low and a logical high to appear at the output of inverter 24 This condition is held thus disabling oscillator 16. The logical high at input terminal 74 is blocked from oscillator 18 via the diode 82 thus allowing the high frequency oscillator 18 to operate. If the pulsation oscillator 20 is freely oscillating while a logical high is applied to input terminal 74, the output of transducer 12 will be a pulsating high frequency tone. In other words, the low frequency oscillator 16 will be totalled disabled while the high frequency oscillator 18 will oscillate during those periods that the output of pulsating oscillator 20 is a logical high.

When a logical low is connected to input terminal 74, it will be blocked from the oscillator 16 by the diode 80 thus allowing that oscillator to operate and it will be transmitted via diode 82 to the input of inverter 34. This will appear as a logical high at the output of inverter 34 and the input of inverter 36 thus holding the output of inverter 36 at a logical low. Thusly, a logical low applied to the input terminal 74 will disable the high frequency oscillator 18. Under these conditions, if the pulsating oscillator 20 is allowed to oscillate freely, the output of piezoelectric transducer 12 will be a pulsating low frequency tone. That is, oscillator 16 will be allowed to operate during those periods of time when the output of oscillator 20 is a logical low.

If a logical high is applied to the input terminal 76, it will be transmitted through the inverters of oscillator 20 and cause the output at circuit 72 to hold at a logical high. As long as this condition exists, the low frequency oscillator 16 will be disabled and the high frequency oscillator 18 will be enabled. While no input signal exists at the input terminal 74, the output of piezoelectric transducer 12 will simply be a high frequency tone. A logical low applied to the input terminal 74 under this condition can be used to control the high frequency output of transducer 12.

If a logical low is applied to the terminal 76, it will hold the output of pulsation oscillator 20 at circuit point 72 to a logical low which will cause disabling of the high frequency oscillator 18 and free oscillation of the oscillator circuit 16. While no input signal is applied to terminal 74 the output of transducer 12 will be a low frequency audio tone. If a logical high is then applied to terminal 74, the low frequency audio tone output may be thereby controlled.

The circuit of FIG. 1 thusly provides a multi-tone signaling device which provides five different output signals namely, low and high frequency audio tones, low and high frequency pulsating tones and a warble. Thusly the signaling capabilities of the present invention are greatly improved over the capabilities of single tone generating devices.

Figure 2:
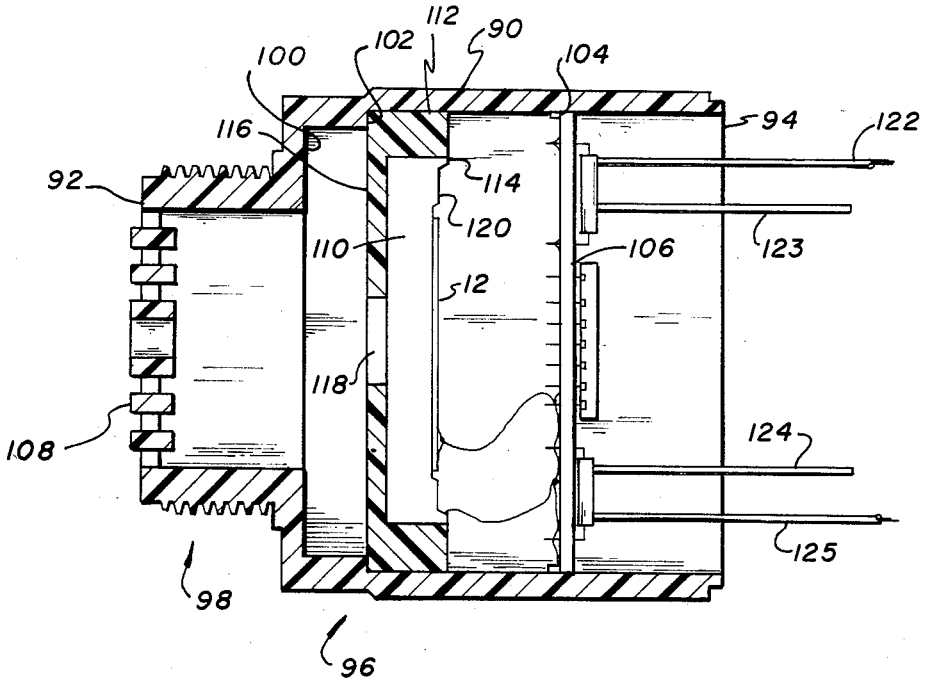
FIG. 2 is a sectional view of a signaling device adapted for use with the circuitry of FIG. 1.

In reference to FIG. 2, a cross section of a signaling device is shown, which device is adapted for use with the circuitry of FIG. 1. The device shown is intended to be cylindrical with the cross section passing through the cylindrical axis. The device includes a housing 90 having a first end 92 for sound output and a second end 94. The front end 92 of the housing 90 includes a grill 108 having openings to allow the passage of sound from the housing 90.

The housing 90 further includes an enlarged rear section 96 and a relatively smaller front section 98. Along the inside of housing 90, three annular shoulders 100, 102 and 104 are shown, each of which faces towards the second end 94 of the housing 90. The first shoulder 100 is located at a dividing point between the enlarged rear section 96 and the smaller front section 98. The annular shoulder 102 is located within the enlarged rear section 96 slightly behind the first shoulder 100. The third shoulder 104 is located closer to the second end 94 of the housing and is used for mounting a printed circuit board 106 which carries the electronic circuitry shown in FIG. 1. The circumferential shoulder 102 is used for mounting an acoustical load cell 112 which includes a cavity 110. (An acoustical load cell, such as 112, is a structure which encloses a small cavity which provides an acoustical load.) The load cell 112 includes a short cylindrical section sized to fit within the diameter of the housing 90 and abuttingly engage the shoulder 102. The cylindrical section of load cell 112 includes an open rear end 114 and a substantially closed front end 116. The front end 116 includes a sound port 118 located axially thereon. The transducer 12 includes a flexible diaphragm 120 which is mounted to the rear end 114 of the load cell 112.

The cavities thusly formed in the housing 90 with the load cell 112 and transducer 12 form a pair of resonant cavities. These cavities cooperate to determine a pair of resonant frequencies for the housing 90, or in other words, to determine a pair of frequencies at which sound production within the housing 90 is enhanced. These two frequencies are approximately equal to the resonant frequencies of the oscillators 16 and 18. A cavity 110 is formed within the load cell 112 between the front end 116 and the transducer 12, and a cavity is formed in housing 90 between the front end of load cell 116 and the grill 108. By the cooperation of these two cavities, oscillations of the transducer 12 are enhanced by natural resonance within the housing 90 both at the low frequency of oscillation of oscillator 16 and at the high frequency of oscillation of oscillator 18.

As previously noted, a circuit board 106 carries the circuitry shown in FIG. 1 and input wires 122 through 125 which correspond to the input terminals 74 and 76 and the voltage inputs of terminals 64 and the system ground 56 of FIG. 1.

When the device is constructed in this manner, a very versatile package is available which provides signaling capabilities for a multiplicity of functions while only necessitating a package of limited size and comparable mounting specifications.

The embodiment described above is intended to be taken in an illustrative and not a limiting sense. Various modifications may be made to the above embodiment by persons skilled in the art without departing from the scope of the present invention as described in the appended claims.

What is claimed is:

1. A signaling device, comprising an audio output device;

a first oscillator circuit means for oscillating at a first frequency;

a second oscillator circuit means for oscillating at a second frequency;

a third oscillator circuit means for oscillating at a third frequency;

means coupling said audio output device to said first and second oscillator circuit means;

first input terminal circuit means coupled to said first and second oscillator circuit means for allowing enabling of either or both of said first and second oscillator circuit means;

circuit means coupling said third oscillator circuit means to said first and second oscillator circuit means for disabling either said first or second oscillator circuit means in response to said third oscillator circuit means; and second input terminal circuit means coupled to said third oscillator circuit means for enabling control of said third oscillator circuit means.

2. The device of claim 1, wherein said third oscillator circuit means is a square wave oscillator having an output which can oscillate between first and second logic states and further wherein said circuit means for disabling includes means for disabling said first oscillator circuit means when said output is in said first logic state and for disabling said second oscillator circuit means when said output is in said second logic state.

3. The device of claim 2, wherein said second input terminal means includes an input terminal, and wherein a logical low voltage level coupled to said input terminal will maintain said output at a logical low state, further wherein a logical high voltage level coupled to said input terminal will maintain said output at a logical high state, and still further wherein a predetermined impedance level coupled to said input terminal will allow said output to oscillate between said low and high logical states.

4. The device of claim 1, wherein said first and second oscillator circuit means are square wave oscillators each having an output which oscillates between high and low logical levels.

5. The device of claim 4, wherein said first input terminal circuit means includes an input terminal and means for disabling said first oscillator circuit means by maintaining said output thereof at a logical high state when a logical high voltage level is applied at said input terminal.

6. The device of claim 5, wherein said first input terminal circuit means includes means for disabling said second oscillator circuit means by maintaining said output thereof at a logical low state when a logical low level is applied at said input terminal.

7. The signaling device of claim 1, further comprising a housing means, said housing means including first and second resonant cavities acoustically coupled to said audio output device, said first and second resonant cavities giving said housing enhanced acoustical output at approximately said first frequency and also at approximately said second frequency.

8. The signaling device of claim 7, wherein said housing means is cylindrical having at least one end and further wherein said housing means includes a load cell means for forming said first resonant cavity.

9. The signaling device of claim 8, further comprising means locating said load cell means within said housing means in spaced relation with said one end for forming said second resonant cavity between said load cell means and said one end.

* * * * *